US010962215B2

(12) United States Patent
Jiang

(10) Patent No.: US 10,962,215 B2
(45) Date of Patent: Mar. 30, 2021

(54) ACTIVE RADIATOR WITH OMNIDIRECTIONAL AIR CONVECTION AND STAGE LIGHTING FIXTURE USING THE SAME

(71) Applicant: Guangzhou Haoyang Electronic Co., Ltd., Guangzhou (CN)

(72) Inventor: Weikai Jiang, Guangzhou (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 16/122,303

(22) Filed: Sep. 5, 2018

(65) Prior Publication Data

US 2019/0049103 A1 Feb. 14, 2019

Related U.S. Application Data

(63) Continuation of application No. PCT/CN2016/098239, filed on Sep. 6, 2016.

(30) Foreign Application Priority Data

Apr. 6, 2016 (CN) ..... 201610208605.9

(51) Int. Cl.
*F28D 15/00* (2006.01)
*F21V 29/503* (2015.01)
(Continued)

(52) U.S. Cl.
CPC ..... *F21V 29/503* (2015.01); *F21V 29/51* (2015.01); *F21V 29/717* (2015.01); *F21V 29/76* (2015.01);
(Continued)

(58) Field of Classification Search
CPC ..... F21V 29/503; F21V 29/51; F21V 29/717; F21V 29/76; F21V 29/83; F21V 29/89;
(Continued)

(56) References Cited

U.S. PATENT DOCUMENTS 6,880,626 B2 * 4/2005 Lindemuth ..... B22F 7/004 165/104.26
6,992,889 B1 * 1/2006 Kashiwagi ..... H01L 23/3675 165/104.33
(Continued)

FOREIGN PATENT DOCUMENTS

CN 1691316 A 11/2005
CN 201898125 U 9/2009
(Continued)

OTHER PUBLICATIONS

International Search Report for PCT/CN2016/098239 dated Dec. 28, 2016.

*Primary Examiner* — Claire E Rojohn, III
(74) *Attorney, Agent, or Firm* — Lerner, David, Littenberg, Krumholz & Mentlik, LLP

(57) ABSTRACT

The present application relates to an active radiator with omnidirectional air convection and a stage lighting fixture using the same. The active radiator includes a radiator body provided with heat dissipation channels and a heat transfer assembly which is at least partially transversely arranged inside the radiator body and in form of an integrity therewith. The present application of simple structure and convenient in use can achieve efficient heat dissipation through omnidirectional active heat dissipation of the stage lighting fixture, and can also reduce overall costs and is easy to install.

12 Claims, 3 Drawing Sheets

(51) Int. Cl.

| | |
|---|---|
| ***F21V 29/83*** | (2015.01) |
| ***F21V 29/76*** | (2015.01) |
| ***F21V 29/51*** | (2015.01) |
| ***F21V 29/71*** | (2015.01) |
| ***F21V 29/89*** | (2015.01) |
| *F21Y 115/10* | (2016.01) |
| *F21W 131/105* | (2006.01) |
| *F21W 131/406* | (2006.01) |

(52) U.S. Cl.
CPC ..... *F21V 29/763* (2015.01); *F21V 29/83* (2015.01); *F21V 29/89* (2015.01); *F21W 2131/105* (2013.01); *F21W 2131/406* (2013.01); *F21Y 2115/10* (2016.08)

(58) Field of Classification Search
CPC ..... F21Y 2115/10; F21W 2131/105; F21W 2131/406
USPC ..... 165/104.33
See application file for complete search history.

(56) References Cited

U.S. PATENT DOCUMENTS 8,018,719 B2 * 9/2011 Busch ..... H01L 23/427 361/700
2005/0237719 A1 * 10/2005 Wang ..... H01L 23/467 361/700
2009/0178787 A1 * 7/2009 Huang ..... H01L 23/427 165/104.33
2011/0006657 A1 * 1/2011 Liu ..... F21V 29/763 313/12
2011/0026251 A1 * 2/2011 Liu ..... F21V 23/008 362/249.02
2011/0048677 A1 * 3/2011 Lin ..... F28F 1/32 165/104.26
2011/0073159 A1 * 3/2011 Shen ..... F21V 29/51 136/246
2011/0090706 A1 * 4/2011 Scott ..... F21V 23/06 362/373
2012/0098401 A1 * 4/2012 Yu ..... F21V 29/767 313/46
2012/0229025 A1 * 9/2012 Edwards, Jr. ..... F21V 31/00 315/35
2014/0036516 A1 * 2/2014 Sampsell ..... G02B 6/0073 362/373
2014/0043810 A1 * 2/2014 Jo ..... F21V 29/83 362/235
2014/0184050 A1 * 7/2014 Mizuta ..... F21V 29/76 313/35
2016/0102854 A1 * 4/2016 Xiang ..... F21V 29/71 362/373
2017/0023228 A1 * 1/2017 Dyson ..... F21V 29/76
2017/0284738 A1 * 10/2017 Watanabe ..... F28F 9/0131

FOREIGN PATENT DOCUMENTS

CN 201306694 Y 7/2011
CN 202082883 U 12/2011
CN 203642005 U 6/2014
CN 204213873 U 3/2015
CN 105716046 A 6/2016
CN 205579514 U 9/2016

* cited by examiner

ACTIVE RADIATOR WITH OMNIDIRECTIONAL AIR CONVECTION AND STAGE LIGHTING FIXTURE USING THE SAME

CROSS REFERENCE TO RELATED APPLICATIONS

The present application is a continuation of International Application No. PCT/CN2016/098239, filed Sep. 6, 2016, which claims priority from Chinese Patent Application No. 201610208605.9 filed Apr. 6, 2016, all of which are hereby incorporated herein by reference.

TECHNICAL FIELD

The present application relates to the technical field of stage lighting, particularly to an active radiator with omnidirectional air convection and a stage lighting fixture using the same.

BACKGROUND

A stage lighting fixture typically has high power consumption when in use. Particularly, a light source of a stage lighting fixture generates a large amount of heat, which will influence on application effects and lifespan of the lighting fixture. Therefore, it's necessary to cool the light source of the stage lighting fixture in time.

In prior art, a heat pipe radiator is typically used to dissipate heat, however such a radiator must be used in combination with a fan to achieve desired heat dissipation effect. Generally, heat generated by a light source of a lighting fixture is diffused by a heat pipe radiator aforementioned and discharged from the lighting fixture by a fan.

Application CN 201320881828.3 discloses an imaging light including a housing, a light source module within the housing, and a lens through which light from the light source module is emitted. The imaging light further includes a heat pipe connected to the light source module and facing toward the lens, fins connected to the heat pipe, and a fan located inside the housing. Such configuration can achieve to dissipate heat, however hot air flows are compulsively discharged out by the fan, resulting in additional equipment, such as a drive circuit and a motor, which are matched with the fan, and higher manufacturing costs. Additionally, heat dissipation is passive due to being dependent on the fan, and it's easy to produce noise when the fan rotates. Further, the configuration is likely to fail as the radiator is spaced closely to the light source module and ambient temperature of the operating motor and fan is high, and such high temperature will cause partial melting of the housing.

Therefore, an active heat dissipation technology is sought-after, which has better heat dissipation effect without additional external force.

SUMMARY

To solve at least one of the above problems in the prior art, the present application provides an active radiator with omnidirectional air convection and a stage lighting fixture using the same, which is of simple structure and convenient in use, and can achieve efficient heat dissipation through omnidirectional active heat dissipation of the stage lighting fixture. In addition, the present invention can also reduce overall costs and is easy to install.

The present invention seeks to provide a solution to the above problems. The present invention relates to an active radiator with omnidirectional air convection including a radiator body provided with heat dissipation channels and a heat transfer assembly which is at least partially transversely arranged inside the radiator body and in form of an integrity with the radiator body. The radiator body includes a first radiator fin group and a second radiator fin group both provided with heat dissipation channels, and the extension direction of heat dissipation channels of the first radiator fin group and that of the second radiator fin group is interlaced with each other, that is, the extension direction of heat dissipation channels of the first radiator fin group and that of the second radiator fin group is not parallel. This allows omnidirectional air convection around the radiator, so that hot air flows can flow omnidirectionally and thus hot air flows around the heat dissipation object will be discharged efficiently.

Further, the second radiator fin group includes two groups respectively arranged on two sides of the first radiator fin group. The first radiator fin group is constituted by a plurality of spaced first radiator fins, and the second radiator fin group is constituted by a plurality of spaced second radiator fins, gaps between the first radiator fins and those between the second radiator fins defining the heat dissipation channels. The number of the first radiator fins and the second radiator fins can be determined based on heat dissipation requirements for the heat dissipation object.

Further, the whole first radiator fin group is in form of inverted T-shaped structure, and the two second radiator fin groups perpendicular to the first radiator fin group are respectively arranged on the stepped recess area on either side of the inverted T-shaped first radiator fin group. This leaves the heat dissipation channels in four directions of front, rear, left, and right sides of the radiator, so that the hot air flows can flow omnidirectionally to form omnidirectional convection, thus hot air flows can be discharged efficiently and promptly.

Further, the heat transfer assembly includes a heat transfer substrate and a plurality of heat transfer pipes. The heat transfer substrate is attached to the first radiator fin group and the second radiator fin group. One end of each of the heat transfer pipes is fixedly attached to the heat transfer substrate, and the other end is configured to string together the second radiator fins of the second radiator fin group and/or string together the first radiator fins of the first radiator fin group. The heat transfer substrate is provided with positioning slots corresponding to the heat transfer pipes. The end of the heat transfer pipes attached to the heat transfer substrate are bent into connection parts fixed in the positioning slots. With the heat transfer assembly, heat generated by the heat dissipation object at the center of the radiator is conducted to the radiator body quickly and then dissipated via air flows in the heat dissipation channels of the radiator body, thereby achieving better heat dissipation effects.

Further, the heat transfer substrate is attached to the radiator body in two manners. In the first manner, the top surface of the second radiator fin group is higher than that of the first radiator fin group. The heat transfer substrate is fixed to the top surface of the first radiator fin group and is partially embedded into the second radiator fin group from lateral sides. Two ends on the heat transfer substrate that correspond to the top surface of the first radiator fin group are separately provided with a third radiator fin group, of which the direction of heat dissipation channels is preferably the same as that of the second radiator fin group, or same as that of the first radiator fin group. The third radiator fin group and the second radiator fin group define a recess for installing the heat dissipation object above the top surface of the first radiator fin group. The heat dissipation object, such as a light source module of a stage lighting fixture, is located in the recess and fixed to the heat transfer substrate with the second radiator fin group and the third radiator fin group around, so that air flows from the heat dissipation channels will directly exchange heat with the heat dissipation object, thereby achieving higher heat dissipation effects.

In the second manner, the top surface of the first radiator fin group is provided with a recess for installing the heat dissipation object, and the top surface of the second radiator fin group is flush with the bottom surface of the recess. The heat transfer substrate is fixed on the surface defined by the top surface of the second radiator fin group and the bottom surface of the recess 9 and partially embedded into the first radiator fin group from two lateral sides of the recess. Two ends on the heat transfer substrate that corresponds to the top surface of the second radiator fin group are separately provided with a third radiator fin group, of which the direction of heat dissipation channels is preferably the same as that of the second radiator fin group, or same as that of the first radiator fin group. The heat dissipation object, such as a light source module of a stage lighting fixture, is located in the recess and fixed to the heat transfer substrate with the first radiator fin group and the third radiator fin group around, so that air flows from the heat dissipation channels will directly exchange heat with the heat dissipation object, thereby achieving higher heat dissipation effects.

Further, the heat transfer substrate in cross shape and the heat transfer pipes are made of copper. With excellent heat transfer properties of copper material, heat generated by the heat dissipation object will be conducted to the radiator body quickly.

The present application also relates to a stage lighting fixture applying the above radiator including a light source module, a radiator according to the present application, a plurality of function modules of the lighting fixture, and a housing, in which the light source module, the radiator, and the plurality of function modules of the lighting fixture are arranged inside the housing, and the plurality of function modules of the lighting fixture are arranged in the optical path in front of the light source module. The radiator is provided with heat dissipation channels around, heat dissipation channels in adjacent directions being perpendicular to each other. A recess is arranged on the top of the radiator, in which the light source module is arranged. The housing is provided with heat dissipation apertures corresponding to the heat dissipation channels of the radiator.

The present application offers additional benefits to the existing prior art. In one aspect, the radiator according to the present application has heat dissipation channels in four directions of front, rear, left, and right sides of the radiator, so that omnidirectional air convection will form around the radiator and hot air flows can flow omnidirectionally, thus hot air flows in the light source module of the stage lighting fixture that applies such radiator can be discharged efficiently. Additionally, according to the present application, heat can be dissipated actively by directly using existing natural resource without any external force, such as a fan, thus achieving efficient heat dissipation of the stage lighting fixture with advantages of lower costs, easy installation and omnidirectional heat dissipation.

DESCRIPTION OF EMBODIMENTS

Figure 1:
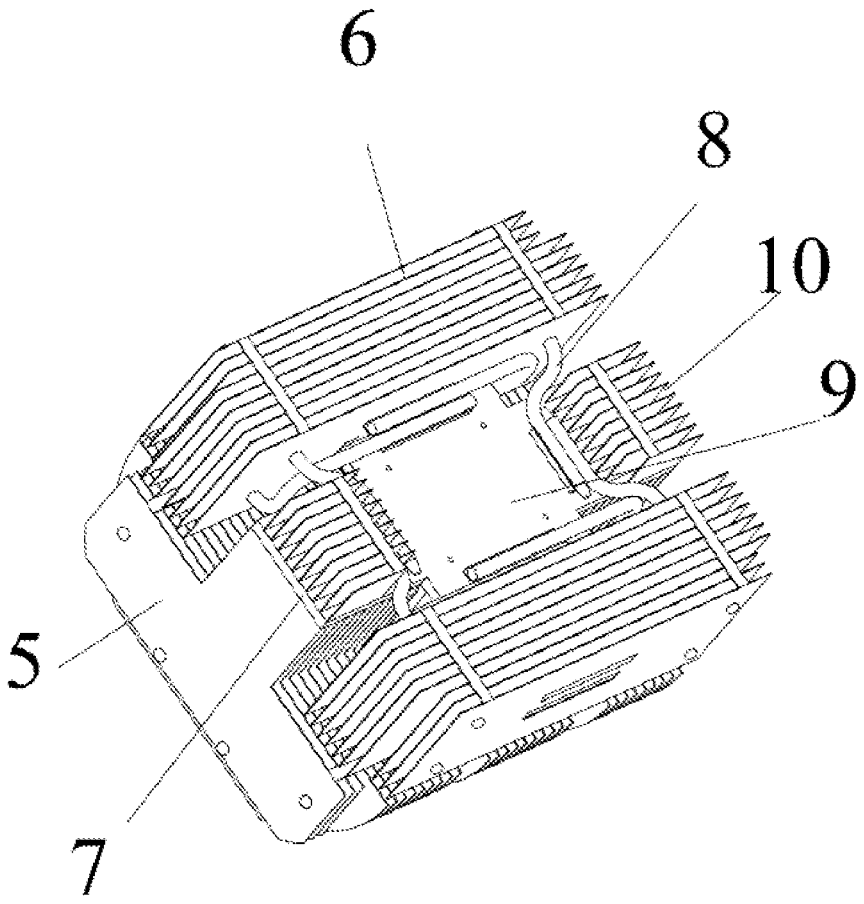
FIG. 1 is an overall schematic view of a radiator according to the present application.

The drawings are for illustration purpose only and are not intended to limit the present application. Some components in the drawings are omitted, enlarged or reduced for better illustrating the embodiments, and sizes of these components do not represent actual sizes of them. For those skilled in the art, it should be understood that some known structures in the drawings and descriptions of these structures are omitted. Positional relationships described in the drawings are for illustration purpose only and are not intended to limit the present application.

Embodiment 1

Figure 2:
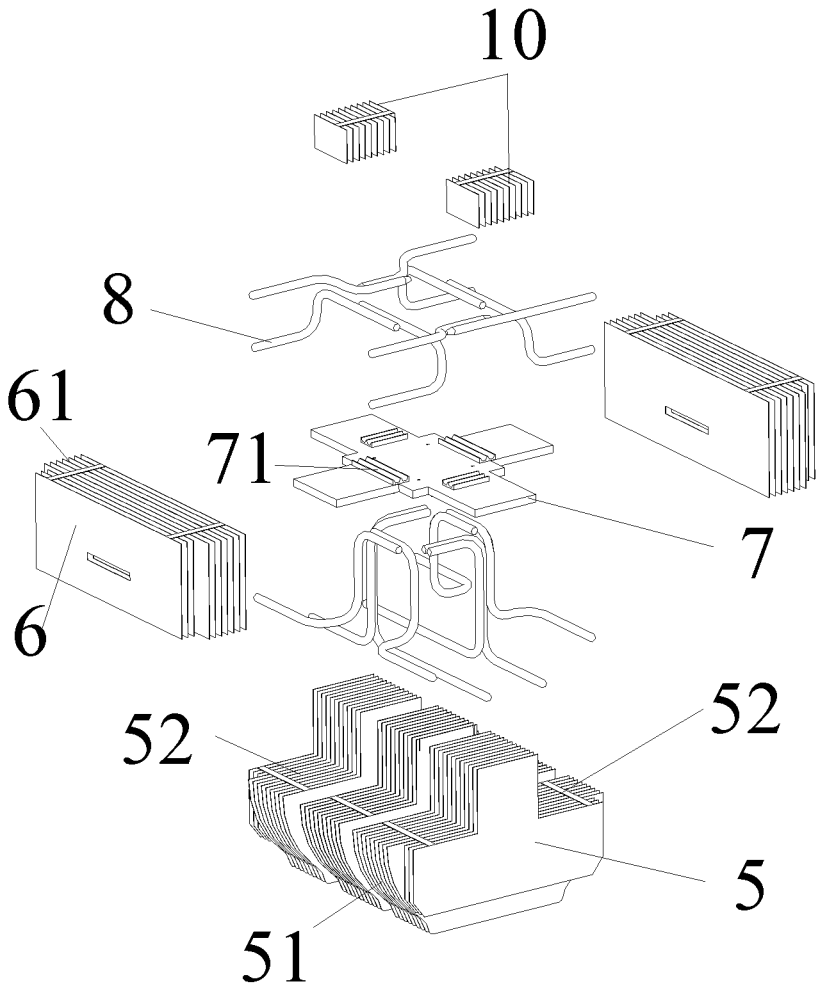
FIG. 2 is an exploded schematic view of the structure in FIG. 1.

As shown in FIGS. 1 and 2, an active radiator with omnidirectional air convection includes a radiator body and a heat transfer assembly which is at least partially transversely arranged inside the radiator body and in form of an integrity therewith. The radiator body is provided with heat dissipation channels and includes a first radiator fin group 5 and a second radiator fin group 6 both provided with heat dissipation channels. The extension direction of heat dissipation channels of the first radiator fin group 5 is interlaced with that of the second radiator fin group 6. This allows omnidirectional air convection around the radiator, so that hot air flows can flow omnidirectionally, and thus the hot air flows around the heat dissipation object will be discharged efficiently.

As shown in FIGS. 1 and 2, the second radiator fin group 6 includes two groups respectively arranged on two sides of the first radiator fin group 5. The first radiator fin group 5 is constituted by a plurality of spaced first radiator fins 51, and the second radiator fin group is constituted by a plurality of spaced second radiator fins 61, gaps between the first radiator fins 51 and those between the second radiator fins 61 defining the heat dissipation channels.

As shown in FIGS. 1 and 2, the whole first radiator fin group 5 is in form of inverted T-shaped structure, and the two second radiator fin groups perpendicular to the first radiator fin group 5 are respectively arranged on the stepped recess areas (52) on either side of the inverted T-shaped first radiator fin group 5. This leaves the heat dissipation channels in four directions of front, rear, left, and right sides of the radiator, so that the hot air flows can flow omnidirectionally and be discharged efficiently.

As shown in FIGS. 1 and 2, the heat transfer assembly includes a heat transfer substrate 7 and a plurality of heat transfer pipes 8. The heat transfer substrate 7 is attached to the first radiator fin group 5 and the second radiator fin group 6. One end of each of the heat transfer pipes 8 is fixedly attached to the heat transfer substrate 7, and the other end thereof is configured to string together the second radiator fins 61 of the second radiator fin group 6 and/or string together the first radiator fins 51 of the first radiator fin group 5. The heat transfer substrate 7 is provided with positioning slots 71 corresponding to the heat transfer pipes 8. The end of the heat transfer pipes 8 attached to the heat transfer substrate 7 are bent into connection parts fixed in the positioning slots 71. With the heat transfer assembly, heat generated by the heat dissipation object at the center of the radiator is conducted to the radiator body quickly and then dissipated via air flows in the heat dissipation channels of the radiator body, thereby achieving better dissipation effects.

As shown in FIGS. 1 and 2, the top surface of the second radiator fin group 6 is higher than that of the first radiator first radiator fin group 5. The heat transfer substrate 7 is fixed to the top surface of the first radiator fin group 5 and is partially embedded into the second radiator fin group 6 from its lateral side. Two ends on the heat transfer substrate 7 corresponding to the top surface of the first radiator fin group 5 are separately provided with a third radiator fin group 10, of which the direction of heat dissipation channels is preferably the same as that of the second radiator fin group 6, or same as that of the first radiator fin group 5. The third radiator fin group 10 and the second radiator fin group 6 define a recess 9 for installing the heat dissipation object above the top surface of the first radiator fin group 5. The heat dissipation object, such as a light source module of a stage lighting fixture, is located in the recess 9 and fixed on the heat transfer substrate 7 with the second radiator fin group 6 and the third radiator fin group 10 around, so that air flows from the heat dissipation channels will directly exchange heat with the heat dissipation object, thereby achieving higher heat dissipation effects.

In this embodiment, the heat transfer substrate 7 in cross shape and the heat transfer pipes 8 are made of copper. With excellent heat transfer properties of copper material, heat generated by the heat dissipation object will be conducted to the radiator body quickly.

Embodiment 2

This embodiment is similar to Embodiment 1 except the installation of the heat transfer substrate 7 and the radiator body. The top surface of the first radiator fin group 5 is provided with a recess 9 for installing the heat dissipation object, and the top surface of the second radiator fin group 6 is flush with the bottom surface of the recess 9. The heat transfer substrate 7 is fixed on the surface defined by the top surface of the second radiator fin group 6 and the bottom surface of the recess 9 and partially embedded in the first radiator fin group 5 from two lateral sides of the recess 9. Two ends on the heat transfer substrate 7 corresponding to the top surface of the second radiator fin group 6 are separately provided with a third the radiator fin group 10, of which the direction of heat dissipation channels is preferably the same as that of the second radiator fin group 6, or same as that of the first radiator first radiator fin group 5. The heat dissipation object, such as a light source module of a stage lighting fixture, is located in the recess 9 and is fixed to the heat transfer substrate 7 with the first radiator fin group 5 and the third radiator fin group 10 around, so that air flows from the heat dissipation channels will directly exchange heat with the heat dissipation object, thereby achieving higher heat dissipation effects. Other configurations and operation principles of this embodiment are similar to those of Embodiment 1.

Embodiment 3

Figure 3:
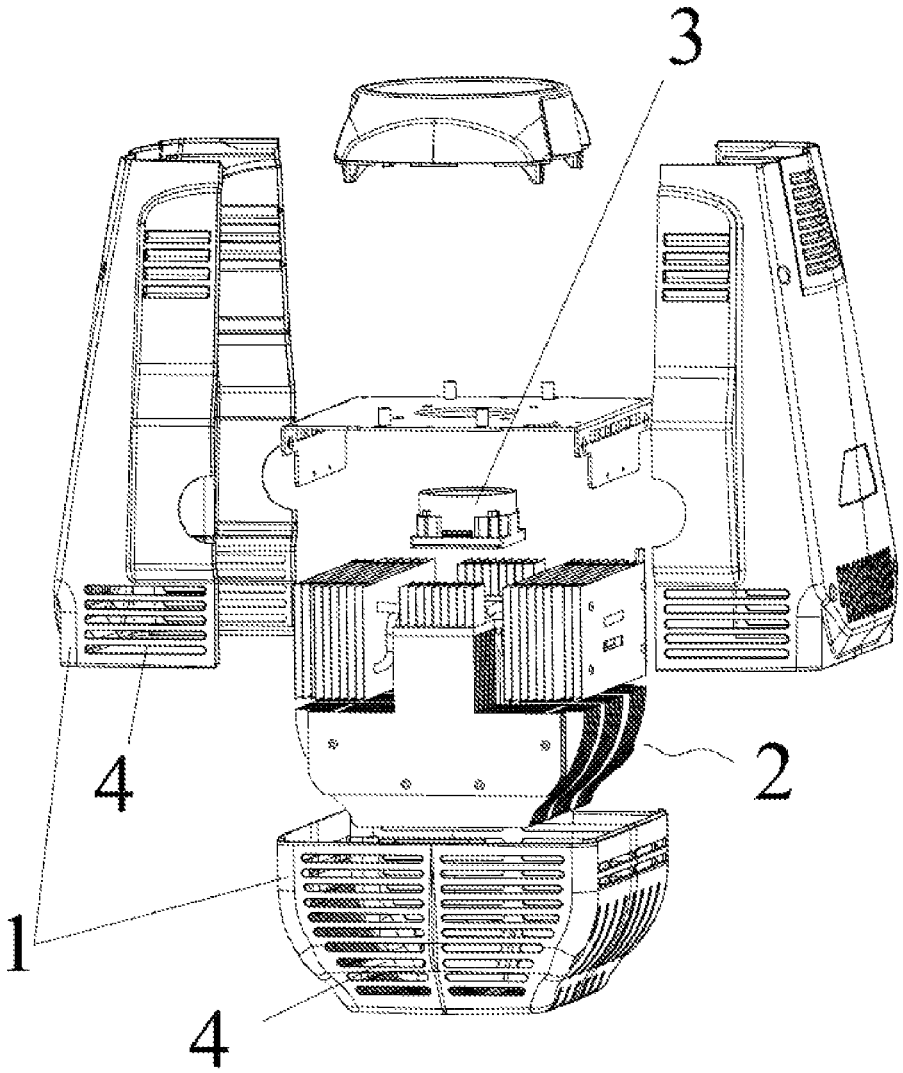
FIG. 3 is an exploded overall schematic view of a stage lighting fixture according to the present application.

FIG. 3 shows a stage lighting fixture including a light source module 3, a radiator 2 having the same structure as shown in Embodiment 1, a plurality of function modules of the lighting fixture, and a housing 1. The light source module 3, the radiator 2, and the function modules of the lighting fixture are arranged inside the housing 1, in which the function modules of the lighting fixture are arranged in the optical path in front of the light source module 3, and the radiator 2 surrounds the periphery and bottom of the light source module 3 from the lower part. The radiator 2 is provided with heat dissipation channels, a recess 9 is arranged above the top of the radiator 2, and the light source module 3 is arranged in the recess 9. The housing 1 is provided with heat dissipation apertures 4 corresponding to the heat dissipation channels of the radiator 2.

Obviously, the above embodiments of the present application are merely examples for clear illustration and are not intended to limit implementations of the present application. For those skilled in the art, modifications or changes can be made on the basis of the above description. There is no need or exhaustion for all implementations. Any modification, equivalent substitution or improvement, and the like within the spirit and principle of the present application should be included in the scope of the claims of the present application.

What is claimed is:

1. An active radiator with omnidirectional air convection comprising:

a radiator body having a first radiator fin group and a second radiator fin group which are both provided with heat dissipation channels, and an extension direction of the heat dissipation channels of the first radiator fin group being nonparallel to the second heat dissipation channels; and a heat transfer assembly at least partially transversely attached to the radiator body;

wherein the first radiator fin group is in form of an inverted T-shaped structure, and the second radiator fin group are of two which are arranged on stepped recess areas on either side of the inverted T-shaped structure, wherein the heat transfer assembly comprises a heat transfer substrate attached to the first radiator fin group and the second radiator fin group, and a plurality of heat transfer pipes, in which one end of each of the heat transfer pipes is fixedly attached to the heat transfer substrate, and other end thereof extends through the first radiator fins or the second radiator fins;

wherein a top surface of the second radiator fin group is higher than a top surface of the first radiator fin group, the heat transfer substrate is fixed to the top surface of the first radiator fin group and is partially embedded into the second radiator fin group from lateral side thereof, and two ends on the heat transfer substrate that correspond to the top surface of the first radiator fin group are separately provided with a third radiator fin group, and wherein the third radiator fin group and the second radiator fin group define a recess for installing a heat dissipation object above the top surface of the first radiator fin group.

2. The active radiator with omnidirectional air convection according to claim 1, wherein the first radiator fin group is constituted by a plurality of first radiator fins arranged at intervals, and the second radiator fin group is constituted by a plurality of second radiator fins arranged at intervals, gaps between the first radiator fins defines the heat dissipation channels of the first radiator fin group and gaps between the second radiator fins defines the heat dissipation channels of the second radiator fin group.

3. The active radiator with omnidirectional air convection according to claim 1, wherein the second radiator fin group is perpendicular to the first radiator fin group.

4. The active radiator with omnidirectional air convection according to claim 1, wherein the heat transfer substrate is provided with positioning slots corresponding to the heat transfer pipes and ends of the heat transfer pipes that are attached to the heat transfer substrate are bent into connection parts fixed in the positioning slots.

5. The active radiator with omnidirectional air convection according to claim 1, wherein the heat transfer substrate forms in cross shape and the heat transfer substrate and the heat transfer pipes are both made of copper.

6. A stage lighting fixture applying the radiator according to claim 1 comprising:

a light source module, a radiator provided with heat dissipation channels and a recess on the top, in which the light source module is arranged in the recess a plurality of function modules of the lighting fixture arranged in the optical path in front of the light source module, and a housing provided with heat dissipation apertures corresponding to the heat dissipation channels of the radiator, inside which the light source module, the radiator, and the plurality of function modules of the lighting fixture are arranged.

7. The active radiator with omnidirectional air convection according to claim 1, wherein some heat transfer pipes are arranged on the heat transfer substrate and one end thereof extends through the second radiator fins, and Some heat transfer pipes are arranged under the heat transfer substrate and one end thereof extends through the stepped recess areas on either side of the inverted T-shaped structure and a central project of the inverted T-shaped structure.

8. An active radiator with omnidirectional air convection comprising:

a radiator body having a first radiator fin group and a second radiator fin group which are both provided with heat dissipation channels, and an extension direction of the heat dissipation channels of the first radiator fin group being nonparallel to the second heat dissipation channels; and a heat transfer assembly at least partially transversely attached to the radiator body;

wherein the first radiator fin group is in form of an inverted T-shaped structure, and the second radiator fin group are of two which are arranged on stepped recess areas on either side of the inverted T-shaped structure, wherein the heat transfer assembly comprises a heat transfer substrate attached to the first radiator fin group and the second radiator fin group, and a plurality of heat transfer pipes, in which one end of each of the heat transfer pipes is fixedly attached to the heat transfer substrate, and other end thereof extends through the first radiator fins or the second radiator fins;

wherein a top surface of the first radiator fin group is provided with a recess for installing a heat dissipation object, and a top surface of the second radiator fin group is flush with a bottom surface of the recess, wherein the heat transfer substrate is fixed on a surface defined by the top surface of the second radiator fin group and the bottom surface of the recess, and is partially embedded into the first radiator fin group from two lateral sides of the recess, and wherein two ends on the heat transfer substrate that corresponds to the top surface of the second radiator fin group are separately provided with a third radiator fin group.

9. The active radiator with omnidirectional air convection according to claim 8, wherein the first radiator fin group is constituted by a plurality of first radiator fins arranged at intervals, and the second radiator fin group is constituted by a plurality of second radiator fins arranged at intervals, gaps between the first radiator fins defines the heat dissipation channels of the first radiator fin group and gaps between the second radiator fins defines the heat dissipation channels of the second radiator fin group.

10. The active radiator with omnidirectional air convection according to claim 8, wherein the second radiator fin group is perpendicular to the first radiator fin group.

11. The active radiator with omnidirectional air convection according to claim 8, wherein the heat transfer substrate is provided with positioning slots corresponding to the heat transfer pipes and ends of the heat transfer pipes that are attached to the heat transfer substrate are bent into connection parts fixed in the positioning slots.

12. The active radiator with omnidirectional air convection according to claim 8, wherein the heat transfer substrate forms in cross shape and the heat transfer substrate and the heat transfer pipes are both made of copper.

* * * * *